US011731022B2

(12) United States Patent
Hilton

(10) Patent No.: US 11,731,022 B2
(45) Date of Patent: Aug. 22, 2023

(54) MARTIAL ARTS SHIN CONDITIONING TARGET

(71) Applicant: Carl K. Hilton, Springfield, AR (US)

(72) Inventor: Carl K. Hilton, Springfield, AR (US)

( * ) Notice: Subject to any disclaimer, the term of this patent is extended or adjusted under 35 U.S.C. 154(b) by 0 days.

(21) Appl. No.: 17/505,160

(22) Filed: Oct. 19, 2021

(65) Prior Publication Data

US 2023/0119244 A1 Apr. 20, 2023

(51) Int. Cl.
*A63B 69/20* (2006.01)

(52) U.S. Cl.
CPC ..... *A63B 69/20* (2013.01); *A63B 69/305* (2022.08); *A63B 2244/10* (2013.01)

(58) Field of Classification Search
CPC ..... A63B 69/20; A63B 69/004; A63B 69/203; A63B 69/205; A63B 69/206; A63B 69/215; A63B 69/22; A63B 69/222; A63B 69/224; A63B 69/24; A63B 69/244; A63B 69/26; A63B 69/305; A63B 69/32; A63B 69/322; A63B 69/325; A63B 2244/10
See application file for complete search history.

(56) References Cited

U.S. PATENT DOCUMENTS 5,261,821 A * 11/1993 Shic ..... A63B 69/004 434/247
5,281,191 A 1/1994 DeSousa
5,800,319 A 9/1998 Choate
5,902,217 A 5/1999 Schechner
6,063,011 A 5/2000 Pelchat
6,302,831 B1 10/2001 Henry
6,398,652 B1 * 6/2002 Schweizer ..... A63B 69/004 463/47.5
8,376,916 B2 * 2/2013 Tsakiris ..... A63B 69/305 482/86
2011/0237404 A1 * 9/2011 Smith ..... A63B 69/305 482/83
2014/0080681 A1 3/2014 Knight
2014/0128226 A1 5/2014 Chang
2015/0099611 A1 * 4/2015 Lyman ..... A63B 69/20 482/83
2022/0080278 A1 * 3/2022 Taylor ..... A63B 69/20

FOREIGN PATENT DOCUMENTS

KR 20070104828 * 4/2007

* cited by examiner

*Primary Examiner* — Megan Anderson
(74) *Attorney, Agent, or Firm* — Stephen D. Carver

(57) ABSTRACT

A portable kicking target for shin conditioning during martial arts training, particularly muai thai. The target may be attached to a conventional punching bag to provide target areas of varying hardness, such that, over time, trainee shin bones and the shin area of the legs are conditioned and strengthened. The target comprises a radially spaced-apart pair of impact pockets that are to be repeatedly kicked. Each impact pocket houses a plurality of elongated, generally parallel, plastic impact tubes. One pocket has a plurality of soft tubes, and the other houses a plurality of harder tubes. The kicker's shins are strengthened over time by repeated contact with the impact pockets. Training starts with the softer impact tubes. After the trainee's shins strengthen, the trainee may increase impact force by switching to the harder impact tubes, and eventually micro fractures will develop as conditioning peaks.

7 Claims, 7 Drawing Sheets

MARTIAL ARTS SHIN CONDITIONING TARGET

BACKGROUND OF THE INVENTION

1. Field of the Invention

The present invention relates generally to martial arts and martial arts kick training devices. More particularly, the present invention relates to impact-absorbing, kicking targets for conditioning student shins during vigorous work-out sessions, especially for training in the art of "muay thai."

2. Description of the Related Art

It has long been recognized by those skilled in the martial arts that extensive training and practice sessions are necessary for mastering the many moves and maneuvers required for success in the martial arts. In the mixed martial arts arena, for example, a variety of both punching and wrestling-like arm and first movements are commonly employed. But concurrently, numerous kicking maneuvers and strikes are repetitively practiced. In the sport of muay thai, many rapid, powerful kicks are executed by participants. Often the combatants shin bones (i.e., the lower part of the leg) impacts the target. As is well known, sudden powerful hits against ones shin bones can be a painful experience. Proper kick targeting and placement are important skills that require substantial practice to master. Further, without first conditioning and training the legs, and especially the shin regions, normal martial arts kicking and targeting can be very painful.

This is particularly poignant when a beginner is starting out in the field and learning the various recommended training techniques. However, practitioners at all stages of development can benefit for adequate repetitive training, and the use of modern training devices and targets.

Thus, for example, U.S. Pat. No. 5,281,191 issued Jan. 25, 1994 discloses a "striking dummy" that is attached to a punching bag and used as a target. The invention is a life-like striking dummy adapted to be attached to a punching bag for training in boxing, martial arts, and other sports. The striking dummy is sculptured three-dimensionally and comprises a first portion configured to anatomically resemble a human head, and is connected by a neck to a second portion configured to anatomically resemble a human torso. A cellular foam core is homogeneously distributed throughout the entire inner structure, and is human-like in density, providing a realistic feel of striking an opponent. The striking dummy is configured with mounting straps for the purpose of attachment to a punching bag.

U.S. Pat. No. 5,800,319 issued Sep. 1, 1998 discloses a sparring device comprising a belt which is fastened upon a vertical columnar member like a punching bag. The sparing device includes at least one outwardly projecting arm portion which is normally disposed in a somewhat horizontal orientation.

U.S. Pat. No. 5,902,217 issued May 11, 1999 discloses a martial arts and boxing accessory for physical training, such as in martial arts, boxing and similar disciplines that involve punching, kicking, and the like. A training accessory that mounts to a heavy training bag and which provides targets or wing chun type blocking arms which the trainee can punch, kick, or block, for example. The training accessory has a frame that mounts to the heavy bag by use of cinch straps. Accessory arms selectively mount to depending bars and carry or define punching, kicking, or striking targets or blocking arms. Straps are secured to the heavy bag to prevent its twisting undesirably in response to torque generated by impacts and blocking movements of the trainee.

U.S. Pat. No. 6,063,011 issued May 16, 2000 discloses a portable martial arts training device adapted to be removably attached to a punching bag or other vertical support. The device main body, absorbs kicks and punches. A plurality of cylindrical targets, extend from and are horizontally supported by the main body, for simulating human arms and legs. These targets can be unmounted, then wrapped within the base, and the entire device fastened by straps thus allowing the device to be transported by the practitioner as would a duffle bag.

U.S. Pat. No. 6,302,831 issued Oct. 16, 2001 discloses a martial arts training device for attachment to a punching bag by one or more connectors. One or more arms are connected in a rigid fashion, so that when a martial arts blow is delivered to the arm, the arm does not move with respect to the punching bag. Rather, the force of the blow is transferred from the arm to the punching bag causing the punching bag to move, as would a martial arts opponent.

U. S. Patent Publication 20140080681 published Mar. 20, 2014 discloses a martial arts training device includes a target for attachment to a punching bag. The target is a hollow shell containing a filler material. The shell is fixed to a strap that includes a mechanism for securing the strap around a punching bag.

U. S. Patent Publication 20140128226 published May 8, 2014 discloses a freestanding mixed martial arts training device comprising vertically connected first and second posts, a base stand connected to a lower end of the first post, a water containable pedestal assembly, and primary and secondary striking pads as well as kick training plates that are adjustable in height. The first post is also connected to the base stand via a plurality of screws, so that striking forces applied to the first and second posts can be evenly distributed to the screws without causing a broken and leaking pedestal assembly due to stress concentration.

However, the known prior art appears to have overlooked the specific training goal of shin conditioning and training. It would therefore seem desirable to provide a martial arts training device, specifically designed for martial arts training in muay thai techniques, that forms a viable and practicable target for kick training, but which at the same time is adapted to absorb impacts from the shin area of a trainees' legs so that the shins of the kicker are gradually toughed up and conditioned for several stresses encountered in vigorous martial arts fights and exhibitions.

BRIEF SUMMARY OF THE INVENTION

This invention provides a portable and deployable kicking target for training in the martial arts. The target is adapted to be temporarily attached to a conventional training punching bag, or similar vertical columnar member, to provide preferred impact target areas for practice kicking. The target areas are impacted by the trainee's shins, and over time the shins are conditioned and strengthened.

The device comprises a portable, foldable blanket-like body whose ends are equipped with hook and loop type fasteners, preferably comprising Velcro®-brand connecting strips, enabling the target to be fastened to a conventional punching bag by first being wrapped around it, and then being appropriately tensioned with the strips making secure contact. The body comprises at least one, and preferably two, impact pockets adapted to be forcibly contacted by the users shins or feet. Each impact pocket houses a plurality of elongated, generally parallel, plastic impact tubes. One impact pocket may include a plurality of relative soft tubes, and the other may house a similar plurality of harder tubes. The tubes are made of plastic, such as polyethylene.

The kicker's shins are gradually strengthened by repeated contact with the impact pockets. Initial training for shin conditioning starts with the softer plastic impact tubes. The softer tubes preferably have a Shore A hardness of 70 and the harder impact tubes preferably have a Shore A hardness of 9-0. After a trainee's shins strengthen and "toughen up" over time from repeated contact with the impact pocket containing the softer impact tubers, the trainee may gradually increase impacting force by aiming at the pocket containing the harder impact tubes. If desired, the impact tubes in the impact pockets may be changed as desired to other strengths or hardnesses. If at the beginning of training the student kicker finds the impact pockets too hard for comfort, the impact tubes within a given impact pocket may be replaced with much softer tubes, decreasing potential pain and discomfort for beginners.

Thus a basic object is to effectively train martial arts students and practitioners in the art of kicking and the proper forms of related maneuvers.

A more specific object is to train and condition the shins of a martial arts practitioner.

Another important object is to provide a portable training device that is easily attached to or detached from a standard conventional punching bag used in martial arts training.

Another fundamental object is to provide a kick training device for muay thai training.

Yet another important object is to provide a training device of the character described that provides kicking targets of varying hardnesses so trainees can gradually work their way up from softer, less painful targets to harder targets preferred by more experienced martial arts practitioners.

A related object is to provide a kicking target for muay thai training, that allows various impact harnesses to be varied.

These and other objects and advantages of the present invention, along with features of novelty appurtenant thereto, will appear or become apparent in the course of the following descriptive sections.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

Figure 1:
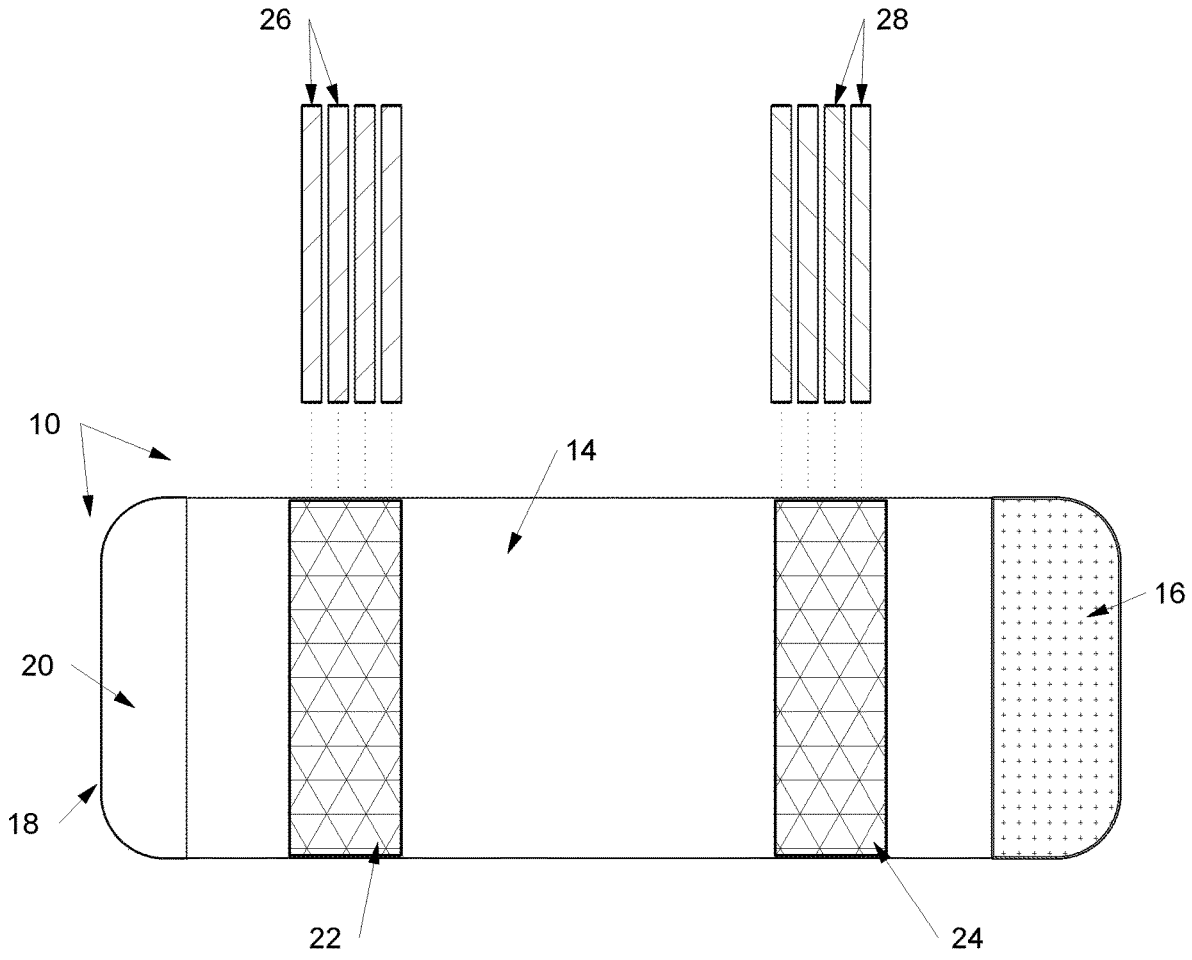
FIG. 1 is a partially exploded front plan view of my preferred martial arts kicking target, showing it undeployed and laid flat for insertion of the preferred impact tubes.

My new martial arts kick training target is especially adapted for shin conditioning and it is especially useful for muay thai kick training. With initial reference directed jointly now to FIGS. 1-4, the preferred kicking target has been generally designated by the reference numeral 10. The target 10 is temporarily attached to a conventional punching bag 12 (FIG. 4) to serve as a target for kicking, and over time, as the target is repeatedly impacted by the trainee's legs, the kicker's shins are conditioned and strengthened. Of course the target 10 maybe be attached to and at least partially folded around other generally cylindrical supports or devices, the punching bag is preferred.

Figure 2:
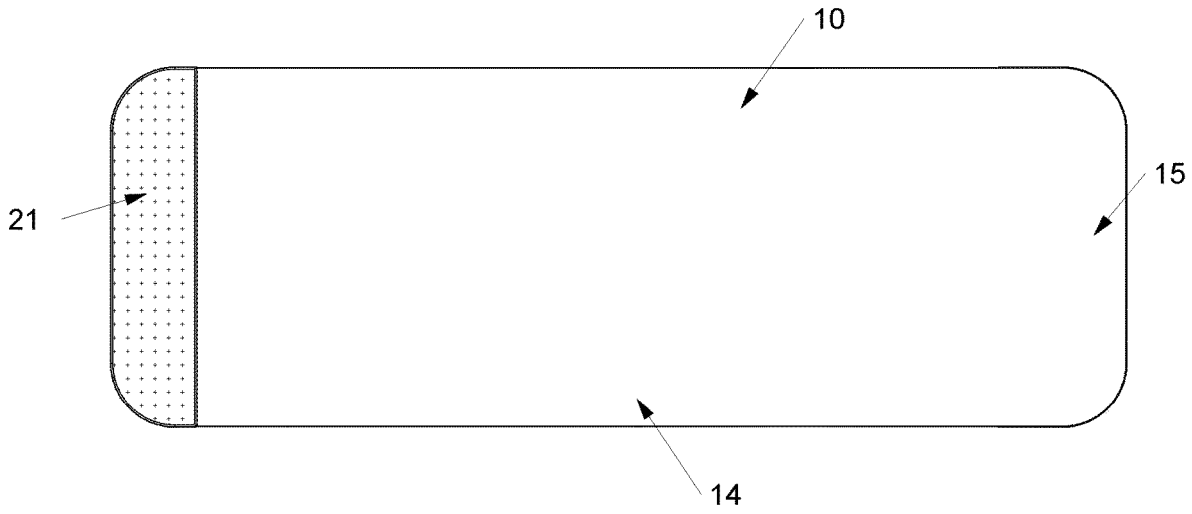
FIG. 2 is a rear plan view of the target showing the rear fastening strip.

The target 10 comprises a flexible, generally rectangular, blanket-like body 14 that is equipped with at least a pair of complimentary connecting strips enabling rapid mounting to a conventional punching bag 12 (FIGS. 4-7) or similar generally cylindrical object. A first connecting strip 16 is disposed at the right end 15 (FIG. 2) of the body 14 (FIG. 1). The left end 18 (FIG. 1) of the target 10 has a complimentary connecting strip 20 whose underside 21 is exposed on the underside of the body 10 (FIG. 2). Each of the connecting strips 16 and 20 is provided with Velcro®-brand material enabling quick mounting and unmounting. The connecting strips 16, 20 thus enable the target 10 to wrap around a generally cylindrical or tubular object. When mated together, the connecting strips 16 and 20 secure the target 10 upon a typically cylindrical structure such as a punching bag, at a selected tension. When properly fastened, the mounted target 10 is semi-permanently secured to the punching bag (FIG. 4) where it will remain in place despite vigorous subsequent impacts from repeated kicking.

Importantly, the body 10 comprises at least one, and preferably two or more spaced-apart impact pockets 22 and 24 that are positioned to be forcibly contacted by the users shins or feet. Each impact pocket 22, 24 houses a plurality of elongated impact tubes 26, 28. In the best mode, the impact tubes are oriented parallel with one another, and generally perpendicular relative to the ground. In the best mode there are four impact tubes in each pocket, but of course more or less impact tubes could be employed. The impact tubes 26 normally disposed in pocket 22 may be made of relatively soft polyethylene to more gently impact the kickers shins. On the other hand, the spaced-apart impact pocket 24 may house a similar plurality of harder or stiffer plastic impact tubes 28 to be targeted as the student kicker progresses. Although the impact tubes are preferably made of a relatively flexible plastic material such as polyethylene, they may be made from fabric materials, rubber, rubber hose materials, or the like.

The impact tubes can have a shore A hardness of between 50 and 80. In the best mode known at this time, the "softer" impact tubes 26 have a Shore A hardness of 70, and the harder impact tubes 28 have a Shore A hardness of 90. The impact tubes are available in many colors, but in the best mode they are colored blue and red. Repeated kicking of the softer impact tubes 26 is recommended for the start of conditioning. Over time during regular training sessions, the kicker's shin area, including the outer skin, toughen. After suitable conditioning, graduation to the harder impact tubes 28 eventually produces micro-fractures in the shin bone region for maximal eventual toughening.

Figure 3:
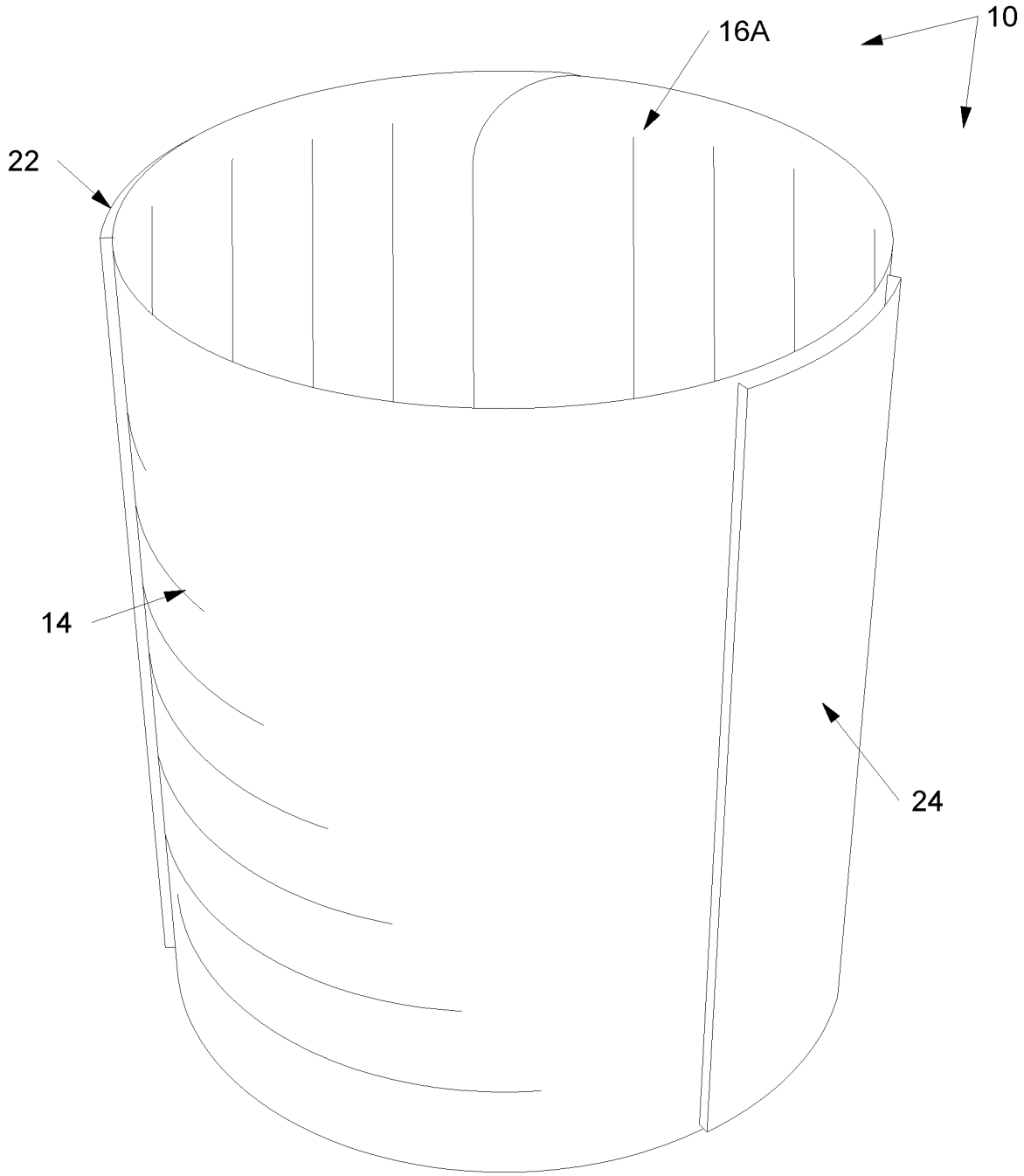
FIG. 3 is an enlarged isometric assembly view showing the target disposed in its normal, generally tubular configuration, with the punching bag and various impact tubes omitted for clarity.

FIG. 3 shows the general configuration of the target 10. It assumes a generally tubular shape to surround a cylindrical object on which it is mounted. The impact pockets 22 and 24 are radially spaced apart from one another about the target circumference. The underside 16A (FIG. 3) of connecting strip 16 has engaged underside 21 of connecting strip 20 on the opposite target end 18.

Figure 4:
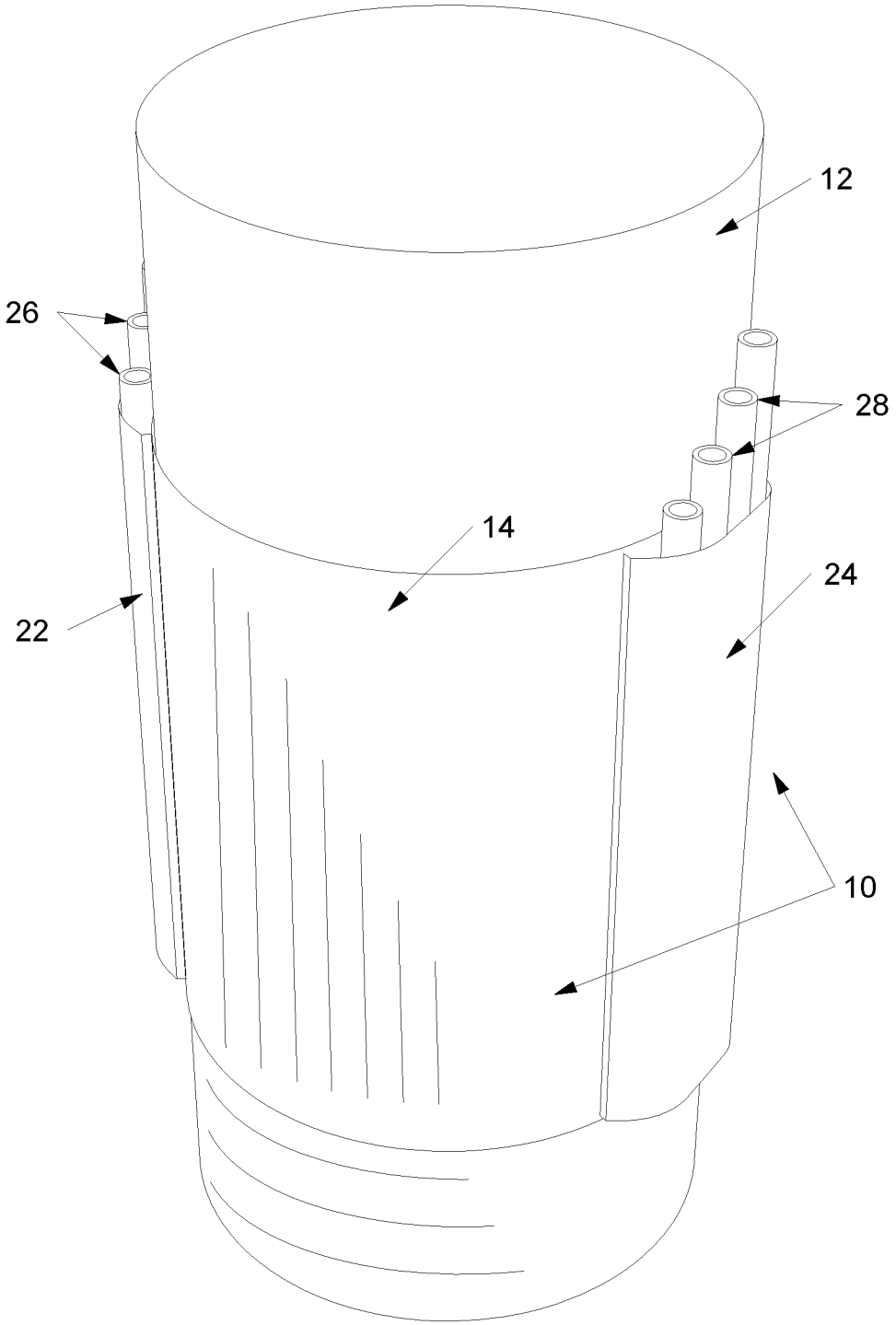
FIG. 4 is an isometric view showing the target attached to a punching bag for use, with various impact tubes moved to an exposed position for viewing clarity.

FIG. 4 shows the target 10 secured to a conventional punching bag 12. Both impact pockets 22 and 24 are shown holding the various impact tubes 26 or 28, with the impact tubes partially withdrawn from their receptive impact pockets for purposes of clarity. When inserted, the impact tubes are fractionally held and maintained by yieldable compression from the pockets against the body 10. The pockets maybe "open" as in FIG. 4 to facilitate the quick installation, removal and replacement of the impact tubes. This is desirable for adapting the target 10 to students of different skill levels and different pain tolerances. However, in the preferred embodiment known at this time, the impact pockets remain closed to more securely brace and hold the impact tubes.

Figure 5:
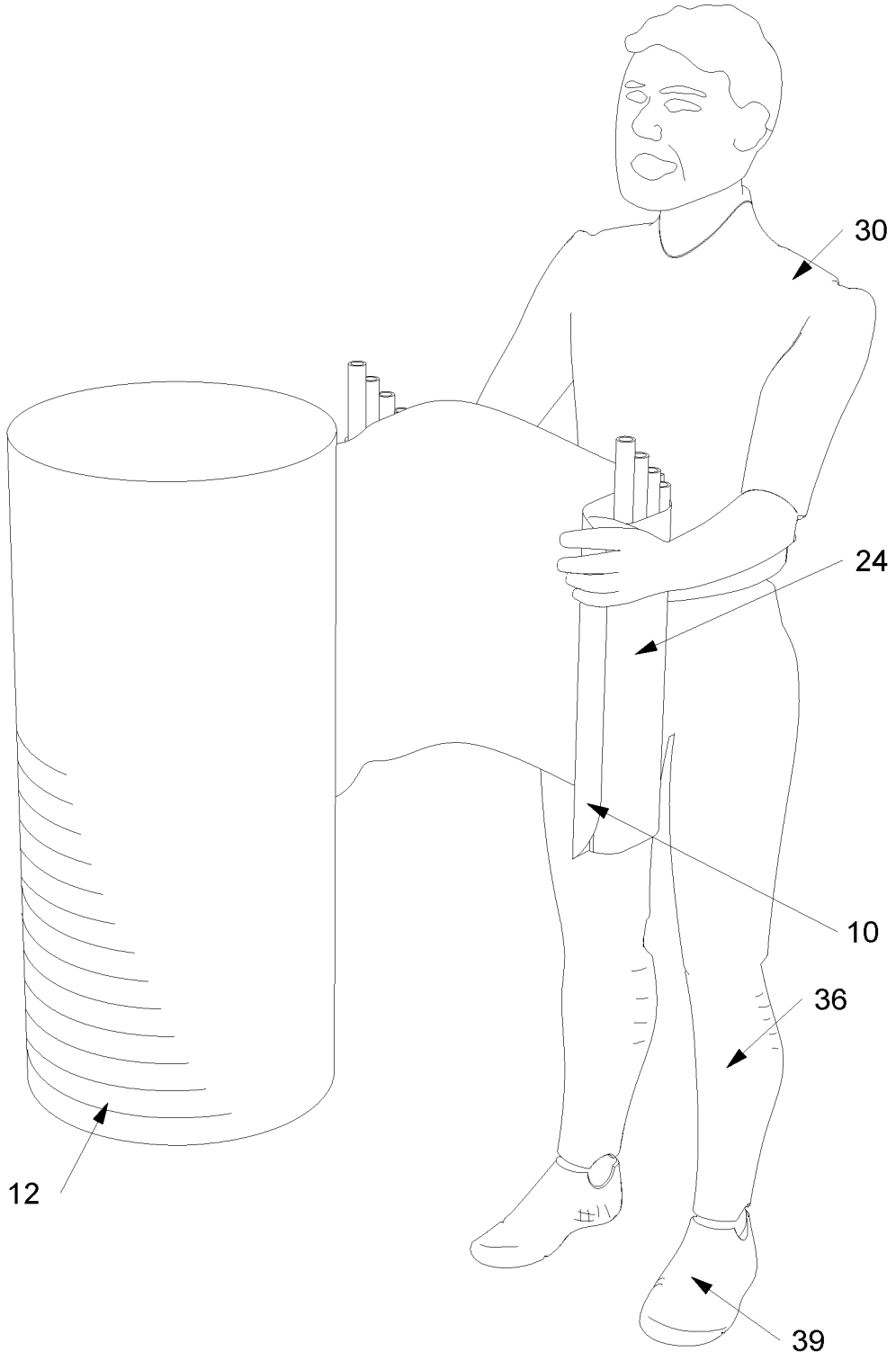
FIG. 5 is a fragmentary pictorial view showing a martial arts trainee, and specifically a muay thai student, beginning to install the practice target on a conventional punching bag.
Figure 6:
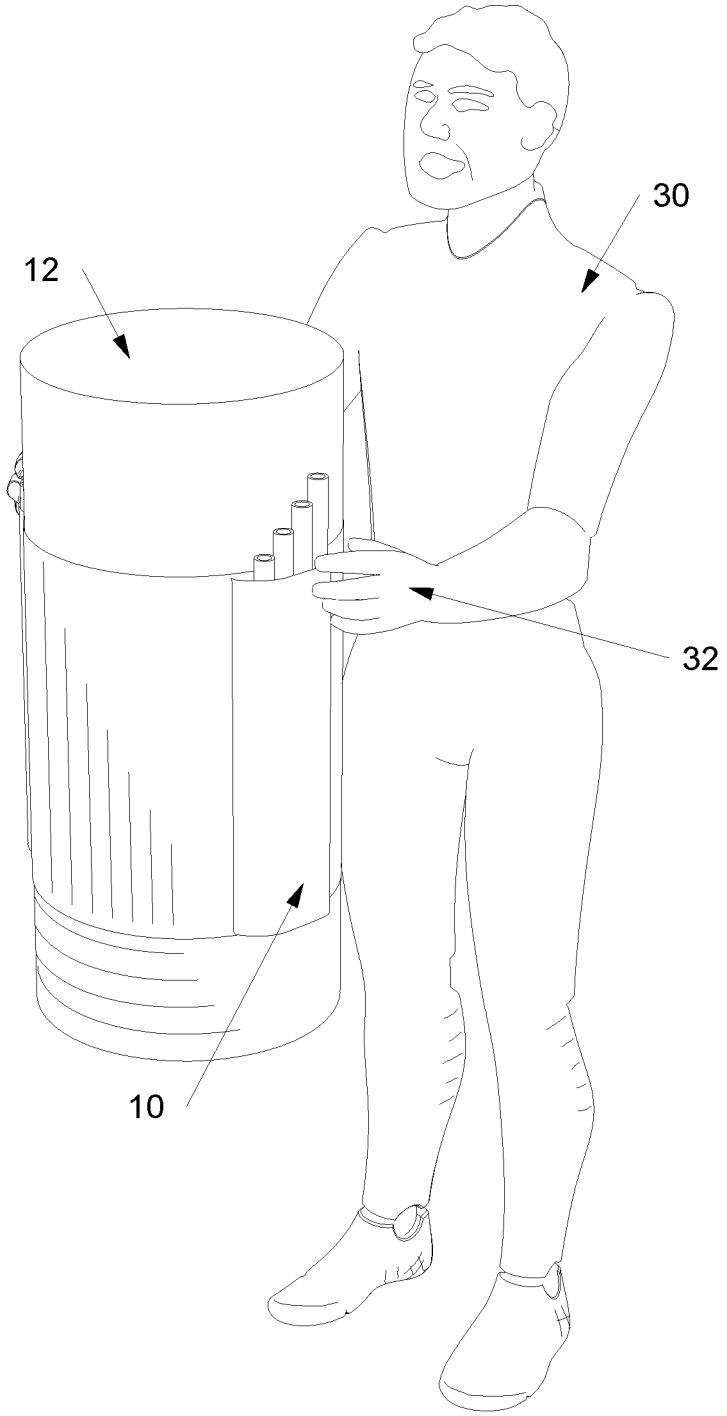
FIG. 6 is a fragmentary pictorial view showing the muay thai trainee tensioning and fastening the practice target around a conventional punching bag; and, FIG. 7 is a fragmentary pictorial view showing the muay thai trainee kicking the target and aiming at a selected impact pocket.

In FIG. 5 a trainee 30 is shown handling the target 10 in an unwrapped and loose position, so that it can be held up to the punching bag 12 for proper placement. In FIG. 6 the muay thai trainee 30 has positioned the target 10 in a concentric, wrapped-around position on the punching bag. The vertical height of the target 10 will be based upon the height of the kicker, the dimensions of the punching bag, and the skill level of the trainee 30.

Figure 7:
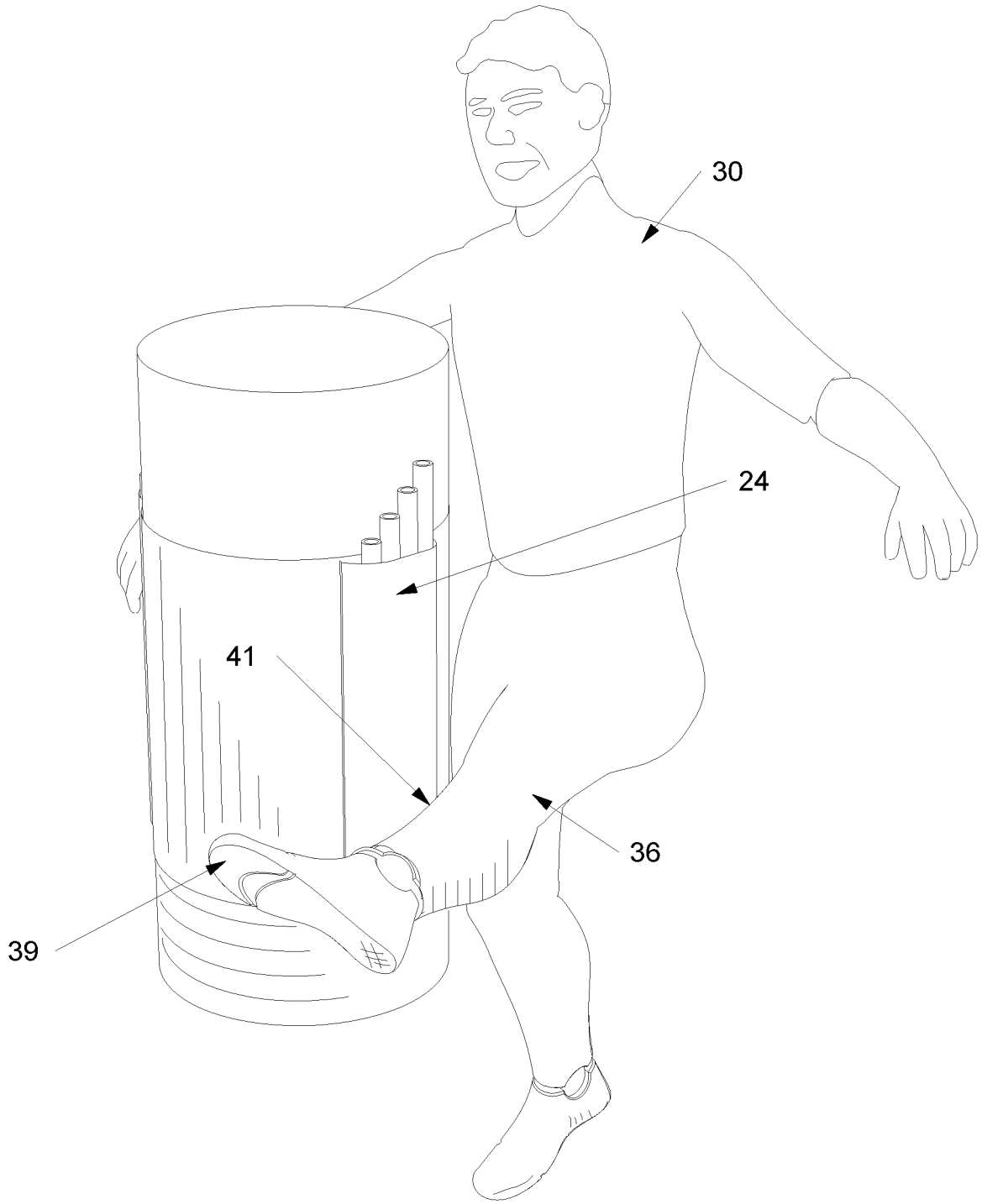

FIG. 7 shows the kicker 30 directing a leg 36 and foot 39 towards an impact pocket 24 on the target 10. The object of course is to strengthen the kicker's shin area 41 by repetitive contact with a selected impact pocket 22 or 24. The kicker's shins can be gradually strengthened by repeated contact with the selected impact pocket, and more particularly by the effect of impact tubes concealed within a selected impact pocket. After beginning shin conditioning training with relatively soft impact tubes disposed in a given impact pocket, the trainee kicker can later switch to harder tubes within a companion impact pocket. After the shins strengthen and "toughen up", and the trainee gains experience, the pain decreases. Later, subsequent training with harder impact tubes will be more productive, and micro-fractures in the shin bone will gradually result. Depending upon the selected target design, the impact tubes in a given impact pocket may be changed to other strengths or hardnesses. When a beginner finds the impact pockets too hard for comfort, the impact tubes within a given impact pocket may be replaced with much softer tubes or softer materials, thus decreasing impact pain and discomfort. When a given training session with a given punching bag or target is completed, the target 10 may be easily removed for transportation and stowage, simply by grasping the opposite ends of the body and gently unfastening the Velcro®-equipped connecting strips 16 (FIG. 1) and 20 (FIG. 2) and drawing them apart.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A muay thai kick training target for shin conditioning, the muay thai kick training target comprising:

a flexible rectangular body adapted to be coupled to a cylindrical support, the body having spaced-apart ends;

the flexible rectangular body comprising complimentary connecting strips associated with said ends for securing the muay thai kick training target to said cylindrical support by coupling said ends of said flexible rectangular body together;

first and second radially spaced-apart impact pockets disposed on the flexible target body;

the first of said impact pockets containing a first plurality of elongated parallel impact tubes for absorbing impacts from a user during kicking practice;

the second of said impact pockets concurrently containing a second plurality of elongated parallel impact tubes for absorbing impacts from the user during kicking practice; and, wherein the first plurality of impact tubes are characterized by a Shore A hardness of 70, and said second plurality of impact tubes are characterized by a Shore A hardness of 90.

2. A muay thai kick training target for shin conditioning, the muay thai kick training target comprising:

a flexible rectangular body adapted to be wrapped around a cylindrical punching bag or columnar support, the flexible rectangular body having spaced-apart ends;

complimentary connecting strips disposed on opposite ends of said flexible rectangular body for securing the muay thai kick training target around said cylindrical punching bag or columnar support by mating together;

first and second radially spaced-apart impact pockets disposed on the flexible rectangular target body;

said first and second radially spaced apart impact pockets each containing at least four parallel plastic impact tubes for absorbing impacts from a user during kicking practice; and, wherein the at least four parallel plastic impact tubes within said first radially spaced apart impact pocket are characterized by a softer hardness than the at least four parallel plastic impact tubes that are concurrently disposed within the second radially spaced apart impact pocket.

3. The muay thai kick training target as defined in claim 2 wherein said at least four parallel plastic impact tubes within said first radially spaced apart impact pocket are characterized by a Shore A hardness of 70, and the at least four parallel plastic impact tubes within said second radially spaced apart impact pocket are characterized by a Shore A hardness of 90.

4. The muay thai kick training target as defined in claim 3 wherein the at least four parallel plastic impact tubes within each of said first and second radially spaced apart impact pockets are made from materials selected from the group consisting of PVC plastic, polyethylene, ABS plastic, or polystyrene.

5. A muay thai kick training target for shin conditioning, the muay thai kick training target comprising:

a flexible rectangular body adapted to be wrapped around a cylindrical punching bag or columnar support, the flexible rectangular body having spaced-apart ends;

complimentary connecting strips disposed on opposite ends of said flexible rectangular body for securing the muay thai kick training target around said cylindrical punching bag or columnar support by mating together;

a first impact pocket disposed on the flexible rectangular body;

a separate, second impact pocket disposed on said flexible rectangular target body, the second impact pocket radially spaced apart from said first impact pocket when the muay thai kick training target is secured around said cylindrical punching bag or columnar support;

the first impact pocket containing a first group of at least four impact tubes characterized by a Shore A hardness of 70; and, the second impact pocket concurrently containing a second group of at least four impact tubes characterized by a Shore A hardness of 90.

6. The muay thai kick training target as defined in claim 5 wherein said complimentary connecting strips comprise hook and loop material.

7. The muay thai kick training target as defined in claim 6 wherein the first and second groups of at least four impact tubes are made from materials selected from the group consisting of PVC plastic, polyethylene, ABS plastic, polystyrene, or rubber.

* * * * *